US007452192B2

(12) United States Patent
Hirota

(10) Patent No.: US 7,452,192 B2
(45) Date of Patent: Nov. 18, 2008

(54) CONTROL VALVE FOR VARIABLE DISPLACEMENT COMPRESSOR

(75) Inventor: Hisatoshi Hirota, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 401 days.

(21) Appl. No.: 11/076,863

(22) Filed: Mar. 11, 2005

(65) Prior Publication Data

US 2005/0201867 A1 Sep. 15, 2005

(30) Foreign Application Priority Data

Mar. 12, 2004 (JP) ..... 2004-070979
Apr. 21, 2004 (JP) ..... 2004-125532

(51) Int. Cl.
*F04B 1/26* (2006.01)
*F16K 31/02* (2006.01)

(52) U.S. Cl. ..... 417/222.2; 251/129.15; 251/129.17

(58) Field of Classification Search ..... 417/222.2, 417/275, 290; 91/499; 251/129.07, 129.15, 251/129.17; 137/625.2, 625.18
See application file for complete search history.

(56) References Cited

U.S. PATENT DOCUMENTS 5,165,863 A * 11/1992 Taguchi ..... 417/222.2
6,394,761 B1 * 5/2002 Hirota ..... 417/222.2
6,688,853 B1 * 2/2004 Burkett et al. ..... 417/222.2
2004/0227007 A1 * 11/2004 Sesser et al. ..... 239/204

FOREIGN PATENT DOCUMENTS

JP 2004-278511 10/2004

OTHER PUBLICATIONS

Patent Abstracts of Japan, Publication No. 2000-110731, published on Apr. 18, 2000.

* cited by examiner

*Primary Examiner*—Devon Kramer
*Assistant Examiner*—Patrick Hamo
(74) *Attorney, Agent, or Firm*—Westerman, Hattori, Daniels & Adrian, LLP.

(57) ABSTRACT

To provide a control valve for a variable displacement compressor using a diaphragm for a pressure-sensing section, which is capable of sensing suction pressure as absolute pressure. A core, a first plunger, and a spring of a solenoid are accommodated in a bottomed sleeve. A diaphragm is welded to an open end of the bottomed sleeve under vacuum atmosphere, whereby an assembly having a vacuum inside is formed. As a result, suction pressure Ps can be sensed as an absolute pressure with reference to a vacuum. The magnetic gap between the first plunger and the core is adjusted by the amount of press-fitting of the core into the bottomed sleeve, and the adjustment of load of the spring incorporated into the bottomed sleeve is made by deforming the bottom of the bottomed sleeve such that it is dented inward.

14 Claims, 9 Drawing Sheets

CONTROL VALVE FOR VARIABLE DISPLACEMENT COMPRESSOR

CROSS-REFERENCES TO RELATED APPLICATIONS, IF ANY

This application claims priority of Japanese Application No. 2004-070979 filed on Mar. 12, 2004 and entitled "CONTROL VALVE FOR VARIABLE DISPLACEMENT COMPRESSOR" and No. 2004-125532 filed on Apr. 21, 2004, entitled "CONTROL VALVE FOR VARIABLE DISPLACEMENT COMPRESSOR".

BACKGROUND OF THE INVENTION (1) Field of the Invention

The present invention relates to a control valve for a variable displacement compressor, and more particularly to a control valve for a variable displacement compressor for controlling refrigerant displacement of a variable displacement compressor for an automotive air conditioner.

(2) Description of the Related Art

A compressor used in a refrigeration cycle of an automotive air conditioner is driven by an engine whose rotational speed varies depending on a traveling condition of the vehicle, and hence incapable of performing rotational speed control. To eliminate the inconvenience, a variable displacement compressor capable of changing the discharge amount of refrigerant is generally employed so as to obtain an adequate refrigerating capacity without being constrained by the rotational speed of the engine.

In a typical variable displacement compressor, a wobble plate is disposed within a crankcase formed gastight, such that the inclination angle thereof can be changed, and driven by the rotational motion of a rotational shaft, for performing wobbling motion, and pistons caused to perform reciprocating motion in a direction parallel to the rotational shaft by the wobbling motion of the wobble plate draw refrigerant from a suction chamber into associated cylinders, compress the refrigerant, and then discharge the same into a discharge chamber. In doing this, the inclination angle of the wobble plate can be varied by changing the pressure in the crankcase, whereby the stroke of the pistons is changed for changing the discharge amount of the refrigerant. The control valve for a variable displacement compressor provides control to change the pressure in the crankcase.

In general, the control valve for variably controlling the displacement of the compressor introduces part of refrigerant discharged at discharge pressure Pd from the discharge chamber into the crankcase formed gastight, and controls pressure Pc in the crankcase through control of the amount of refrigerant thus introduced. The amount of introduced refrigerant is controlled according to suction pressure Ps in the suction chamber. That is, the control valve for a variable displacement compressor senses the suction pressure Ps, and controls the flow rate of refrigerant introduced at discharge pressure Pd from the discharge chamber into the crankcase, so as to maintain the suction pressure Ps at a constant level.

To this end, the control valve for a variable displacement compressor is equipped with a diaphragm for sensing the suction pressure Ps, and a valve section for causing a passage leading from the discharge chamber to the crankcase to open and close according to the suction pressure Ps sensed by the diaphragm. Further, a type of the control valve for a variable displacement compressor which is capable of freely externally setting a value of suction pressure Ps to be assumed at the start of the variable displacement operation is equipped with a solenoid that enables configuration of settings of the diaphragm by external electric current.

By the way, conventional control valves for variable displacement compressors which can be externally controlled include a type for controlling a so-called clutchless variable displacement compressor that is configured such that an engine is directly connected to a rotational shaft on which a wobble plate is fitted, without providing an electromagnetic clutch between the engine and the rotational shaft for execution and inhibition of transmission of a driving force of the engine (see e.g. Japanese Unexamined Patent Publication (Kokai) No. 2000-110731 (Paragraph numbers [0010], [0044], and FIG. 1)).

This control valve comprises a valve section causing a passage leading from a discharge chamber to a crankcase to be opened and closed, a solenoid for generating an electromagnetic force causing the valve section to operate in the closing direction, and a diaphragm for causing the valve section to operate in the opening direction as suction pressure Ps becomes lower compared with atmospheric pressure, the valve section, the solenoid, and the diaphragm being arranged in this order. Therefore, when the solenoid is not energized, the valve section is fully open, whereby pressure Pc in the crankcase can be maintained at a level close to the discharge pressure Pd. This causes the wobble plate to become approximately at right angles to the rotational shaft, enabling the variable displacement compressor to operate with the minimum capacity. Thus, the refrigerant displacement can be substantially reduced to approximately zero even though the engine is directly connected to the rotational shaft, whereby the solenoid clutch can be dispensed with.

However, the conventional control valve for controlling a variable displacement compressor having no use for the electromagnetic clutch is configured such that the diaphragm and the valve section are arranged with the solenoid interposed therebetween, and the suction pressure Ps is introduced to the diaphragm which compares the suction pressure Ps with atmospheric pressure, via the solenoid. This necessitates the solenoid in its entirety to be accommodated within a pressure chamber, and hence components of the solenoid need to be designed with considerations given to resistance to pressure.

To eliminate this inconvenience, the present applicant has proposed a control valve for a variable displacement compressor configured such that the plunger of a solenoid is divided into a first plunger and a second plunger, and a diaphragm is interposed therebetween for sensing suction pressure Ps, whereby the valve lift of a valve section for controlling pressure in a crankcase is controlled by the second divisional plunger (Japanese Patent Application No. 2003-289581). Due to the arrangement described above, the diaphragm fluidically separates a space having the first plunger disposed therein and a space having the second plunger disposed therein from each other. Therefore, a section extending from the valve section to a portion where the diaphragm is disposed, including the second plunger which controls the valve lift of the valve section, is formed as a block to which pressure is applied, and the solenoid exclusive of the second plunger is not accommodated in the pressure chamber, allowing the same to be configured to be open to the atmosphere. Moreover, the second plunger which controls the valve lift of the valve section is urged in a direction away from the diaphragm, so that when the solenoid is not energized, displacement of the diaphragm is not transmitted to the valve section, and at the same time the valve section is held in its fully-open state, thereby enabling the variable displacement compressor to be controlled to the minimum displacement.

The first plunger and the second plunger as the divisional plungers of the solenoid are separated from each other when the solenoid is not energized, whereas when the solenoid is: energized, they are attracted to each other to behave as one plunger. Therefore, when the solenoid is energized, first, the first plunger and the second plunger are attracted to each other, and control is performed by these plungers integrated into one plunger in the same manner as conventionally performed.

However, in the control valve having a pressure-sensing section implemented by a diaphragm, the relative pressure between the suction pressure Ps and atmospheric pressure is sensed, and hence due to a change in atmospheric pressure between when the vehicle is running on a road at a high altitude and when the vehicle is running on a road at a low altitude, there occurs a control error.

SUMMARY OF THE INVENTION

The present invention has been made in view of this problem, and an object thereof is to provide a control valve for a variable displacement compressor using a diaphragm for a pressure-sensing section, which is capable of sensing suction pressure as absolute pressure.

To solve the above problem, the present invention provides a control valve for a variable displacement compressor, which is mounted on the variable displacement compressor for control of pressure in a gastightly-formed crankcase by sensing suction pressure, comprising a vacuum container that contains a first plunger in a state urged in a direction away from a core of a solenoid, a diaphragm for sensing the suction pressure, the diaphragm sealing an open end of the vacuum container such that an inside of the vacuum container is kept gastight and having an inner surface with which the first plunger is in abutment in an urged state, and a second plunger that is disposed between the diaphragm and a valve section for controlling pressure in the crankcase, and urged in a direction away from the diaphragm such that the second plunger opens the valve section when the solenoid is not energized.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Figure 1:
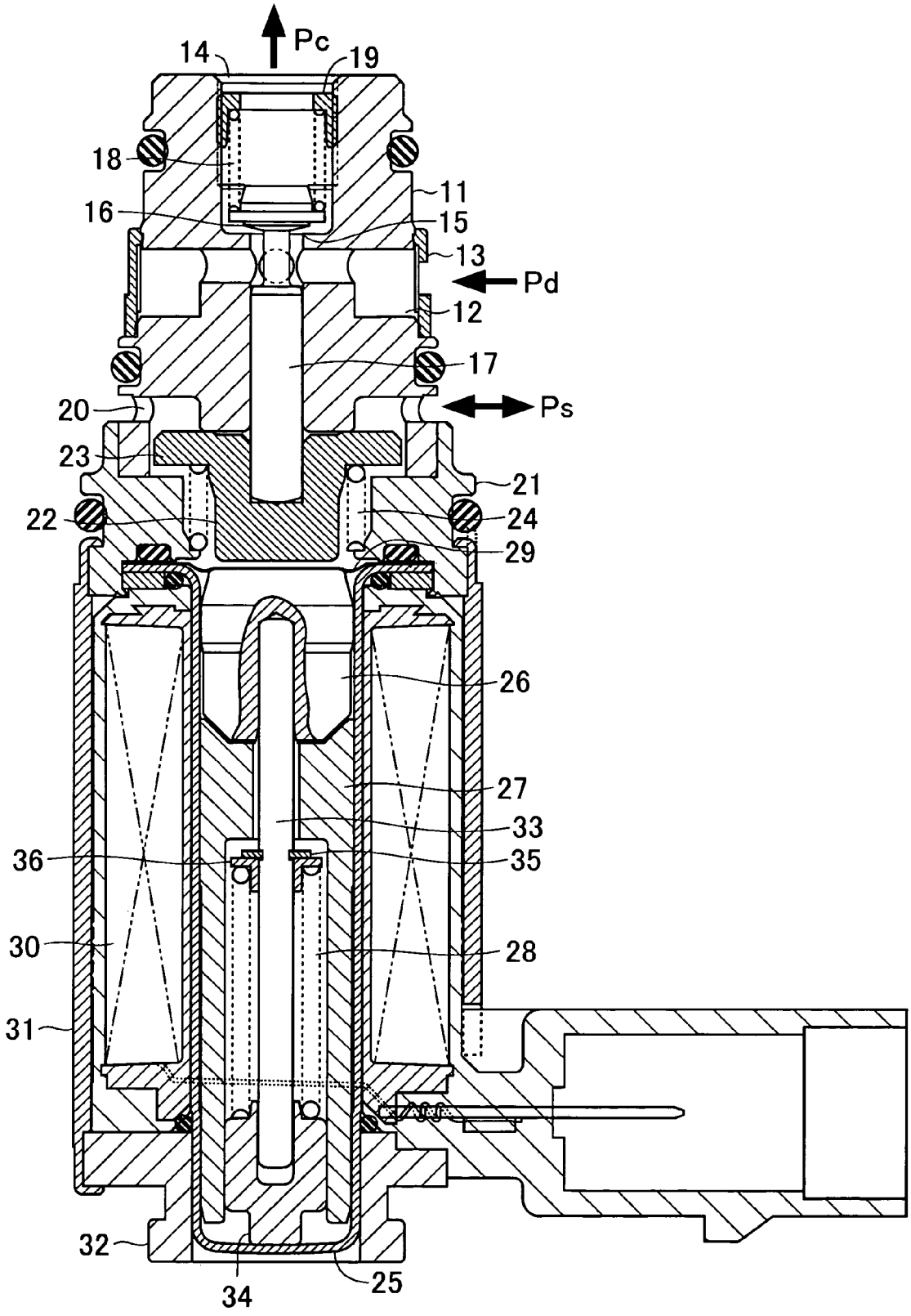
FIG. 1 is a central longitudinal cross-sectional view of the arrangement of a control valve for a variable displacement compressor, according to a first embodiment of the present invention.
Figure 2:
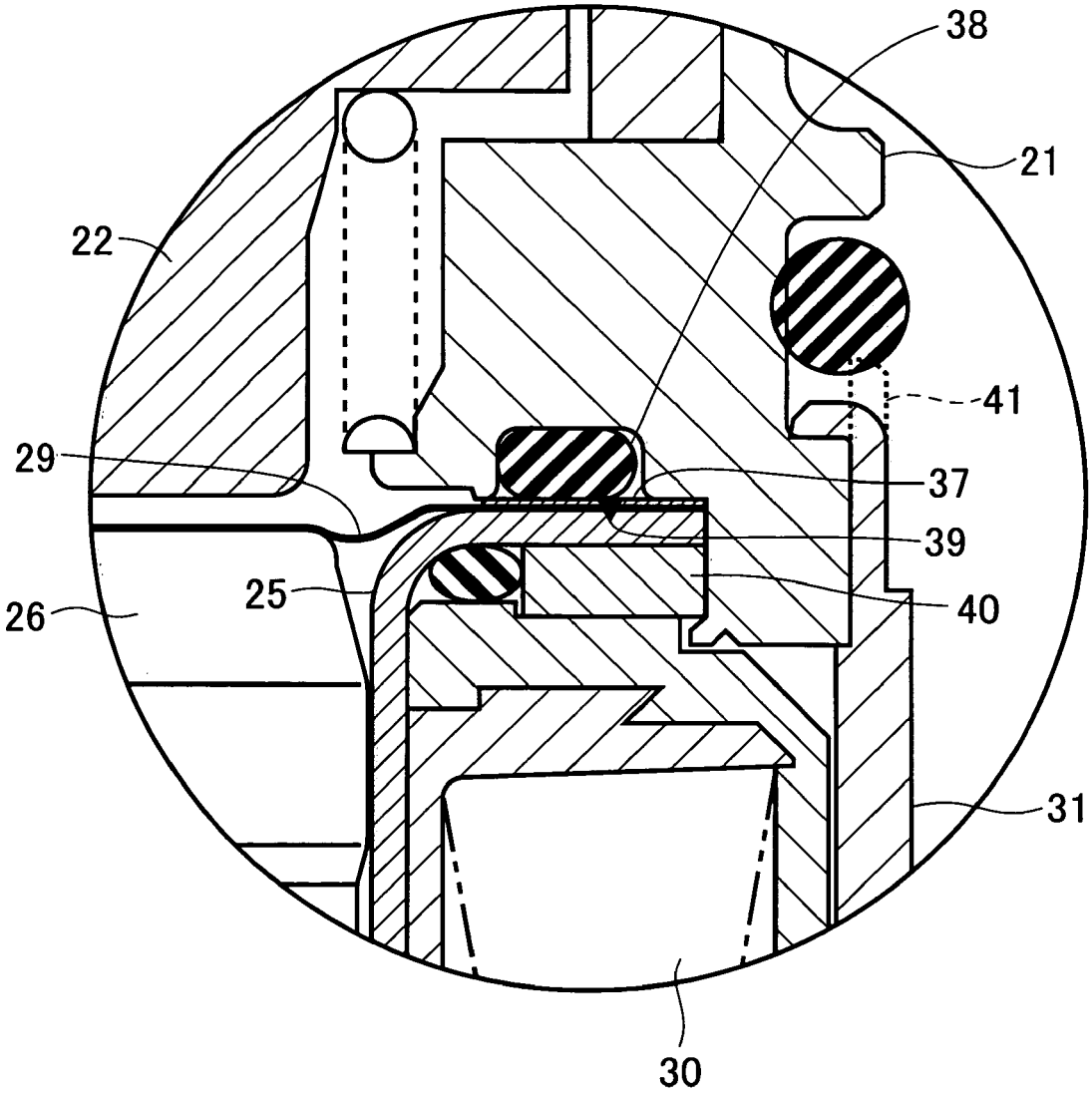
FIG. 2 is an enlarged fragmentary cross-sectional view showing a welded portion of a diaphragm.
Figure 3:
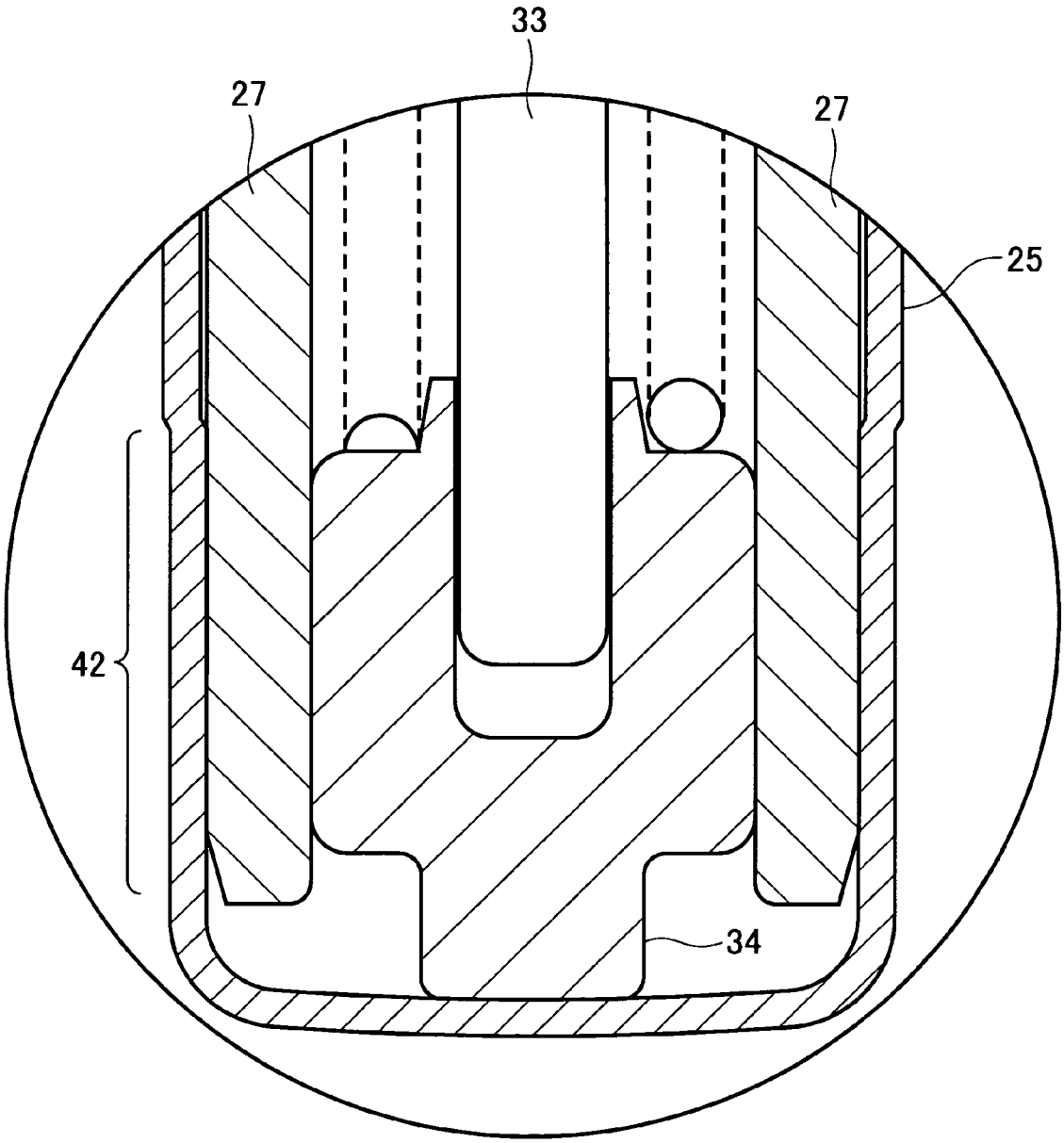
FIG. 3 is an enlarged fragmentary cross-sectional view showing a press-fitting portion of a bottomed sleeve.

FIG. 1 is a central longitudinal cross-sectional view of the arrangement of a control valve for a variable displacement compressor, according to a first embodiment of the present invention. FIG. 2 is an enlarged fragmentary cross-sectional view showing a welded portion of a diaphragm. FIG. 3 is an enlarged fragmentary cross-sectional view showing a press-fitting portion of a bottomed sleeve.

This control valve for a variable displacement compressor has a valve section provided at an upper location, as viewed in FIG. 1. The valve section includes a body 11 formed with a side opening which communicates with a discharge chamber of the variable displacement compressor to form a port 12 for receiving discharge pressure Pd from the discharge chamber. The port 12 has a strainer 13 fixed to the periphery thereof. The port 12 for receiving the discharge pressure Pd communicates with a port 14 opening in the top of the body 11, via a refrigerant passage through the inside of the body 11. The port 14 communicates with the crankcase of the variable displacement compressor so as to introduce controlled pressure Pc in the crankcase.

In the refrigerant passage via which the port 12 and the port 14 are communicated through the body 11, a valve seat 15 is formed integrally with the body 11. In opposed relation to a side of the valve seat 15, from which the pressure Pc is introduced, a valve element 16 is axially disposed in a manner movable to and away from the valve seat 15. The valve element 16 is integrally formed with a shaft 17 which extends downward as viewed in the figure through a valve hole such that it is axially movably held by the body 11. The discharge pressure Pd from the discharge chamber is introduced into a reduced-diameter portion which connects between the valve element 16 and the shaft 17. The outer diameter of the shaft 17 is set to be equal to the inner diameter of the valve hole forming the valve seat 15 such that the pressure-receiving area of the valve element 16 is equal to that of the shaft 17. This causes a force of the discharge pressure Pd which acts on the valve element 16 in the upward direction as viewed in the figure to be cancelled out by a force acting on the shaft 17 in the downward direction as viewed in the figure, so as to prevent the control of the valve section from being adversely affected by the discharge pressure Pd which is high in pressure level.

The valve element 16 is urged by a spring 18 in the valve-closing direction, and load of the spring 18 is adjusted by an adjustment screw 19 screwed into the port 14.

Further, a port 20 communicating with a suction chamber of the variable displacement compressor to receive suction pressure Ps is formed in a lower portion of the body 11 as viewed in the figure.

The lower end of the body 11 is rigidly press-fitted in a body 21 of a magnetic material forming a part of the solenoid. Arranged within the body 21 is a second plunger 22 as one of divisional plungers of a solenoid. The second plunger 22 is supported and centered by a shaft 17 axially held by the body 11 in a manner movable forward and backward with almost no clearance between the same and the body 11. The second plunger 22 is also formed to have a T shape in cross-section, and a lower surface of a flange 23 thereof as viewed in FIG. 1 is opposed to an upper surface of the body 21 as viewed in FIG. 1. This causes an axial attractive force to be generated between the opposed surfaces of the flange 23 and the body 21 to thereby assisting the valve section in promptly moving in the valve-closing direction. Further, the second plunger 22 is urged by a spring 24 disposed between the same and a stepped portion formed inside the body 21, upward as viewed in FIG. 1. The spring 24 has a larger spring force than that of the spring 18 urging the valve element 16 in the valve-closing direction. Therefore, when the solenoid is not energized, the second plunger 22 can push the shaft 17 upward until the shaft 17 is brought into abutment with the ceiling of a chamber communicating with the port 20, and hold the valve element 16 in its fully open position.

Below the second plunger 22 as viewed in FIG. 1, there are arranged the pressure-sensing section and the remaining component parts of the solenoid. More specifically, below the second plunger 22 as viewed in FIG. 1, there is disposed an assembly that is formed by accommodating a first plunger 26 as the other of divisional plungers of the solenoid, a core 27, and a spring 28, in the bottomed sleeve 25 forming the vacuum container, and sealing the opening of the bottomed sleeve 25 with a metal diaphragm 29, and outside the bottomed sleeve 25, there are arranged a coil 30, and a case 31 and a handle 32 of magnetic materials which constitute a yoke for forming a magnetic circuit.

In the bottomed sleeve 25, the core 27 is rigidly press-fitted and the first plunger 26 is disposed on a side of the core 27 toward the valve section in a manner axially movable forward and backward. The first plunger 26 is rigidly press-fitted on one end of a shaft 33 axially extending in the center of the core 27, and the other end of the shaft 33 is supported by a bearing 34 slidably disposed in the core 27. A stop ring 35 is fitted on an intermediate portion of the shaft 33, and a spring-receiving member 36 is provided such that the upward movement thereof as viewed in FIG. 1 is restricted by the stop ring 35. The spring 28 is interposed between the spring-receiving member 36 and the bearing 34. The first plunger 26 is urged by the spring 28 via the shaft 33 in a direction away from the core 27. It should be noted that load of the spring 28 can be changed by externally adjusting the axial position of the bearing 34. More specifically, in final adjustment after assembly of the control valve for a variable displacement compressor, the bottom of the bottomed sleeve 25 is pushed to be deformed inward, whereby the axial position of the bearing 34 in abutment with the bottom is changed to adjust the load of the spring 28. Thus, the set point of the control valve is adjusted.

The bottomed sleeve 25 accommodating the first plunger 26 and the core 27 as described above is sealed by welding the diaphragm 29 to a flange portion formed on the open end of the bottomed sleeve 25. For example, as shown in detail in FIG. 2, the diaphragm 29 is placed on the flange portion of the bottomed sleeve 25 and circumferentially welded to the flange portion along the entire perimeter thereof via an annular patch 37 by laser welding, resistance welding, or the like, under vacuum atmosphere, whereby the gastight assembly is formed such that the inside thereof is maintained under vacuum.

An O ring 38 for sealing between a chamber at the suction pressure Ps where the second plunger 22 is accommodated and the atmosphere is disposed such that the center of the solid part of the O ring 38 is positioned at a location radially inward of a weld line 39. Thus, stress generated by the displacement of the diaphragm is prevented from reaching the weld line 39 which has become fragile due to a change in material caused by the welding.

Further, this assembly is fixed to the body 21 via a reinforcing ring 40 by positioning the flange portion of the bottomed sleeve 25 in a recess formed in the lower end of the body 21 and caulking the peripheral wall of the recess. Then, the case 31 accommodating the coil 30 is fixed to the body 21 by caulking an upper end 41 of the case 31.

The bottomed sleeve 25 is formed by deep-drawing of a stainless steel material, such as SUS304. The bottomed sleeve 25 is required to be formed of a non-magnetic substance so as to prevent the bottomed sleeve 25 from attracting the first plunger 26 during energization of the solenoid and thereby increasing sliding resistance. However, SUS304 is known to have a property that when subjected to strong cold working, it acquires magnetism due to a partial change in its metallic crystal structure. In such a case, the bottomed sleeve 25 is made non-magnetic again by subjecting the same to annealing.

On the other hand, the bottomed sleeve 25 also includes a portion which is desirably magnetic in view of the magnetic circuit. The portion is in an area in which is located the handle 32 magnetically connecting between the core 27 and the case 31. For this reason, a part of the bottom-side portion of the bottomed sleeve 25 which is formed by deep drawing to extend straight, is further drawn as shown in detail in FIG. 3. More specifically, the part of the bottom-side portion of the bottomed sleeve 25 is subjected to strong cold working such that its diameter is reduced, whereby the part of the bottom-side portion can be caused to acquire magnetism to increase magnetic permeability. The drawn part of the bottom-side portion of the bottomed sleeve 25 has its diameter reduced to form a press-fitting portion 42 used for rigidly press-fitting the core 27 in the bottomed sleeve 25. In this press-fitting portion 42, the amount of press-fitting of the core 27 is adjusted to adjust the magnitude of the magnetic gap between the core 27 and the first plunger 26.

It should be noted that when the bottomed sleeve 25 is made of a stainless steel, the diaphragm 29 is also made of a stainless steel material for springs, called SUS304CSP, in view of welding. Of course, the materials of the bottomed sleeve 25 and the diaphragm 29 are not limited to the stainless steel materials, but it is also possible to use copper for the bottomed sleeve 25, and beryllium copper for the diaphragm 29.

In the arrangement described above, the body 21, the case 31, and the handle 32 are formed of magnetic substances to serve as the yoke of the magnetic circuit of the solenoid. Magnetic lines of force generated by the coil 30 pass through the magnetic circuit formed by the case 31, the body 21, the second plunger 22, the first plunger 26, the core 27, and the handle 32.

FIG. 1 shows a state of the control valve for a variable displacement compressor, in which the solenoid is not energized and the suction pressure Ps is high, i.e. a state in which an air conditioner is not operating. Since the suction pressure Ps is high, the diaphragm 29 is displaced downward, as viewed in the figure, against the load of the spring 28 to bring the first plunger 26 into abutment with the core 27. On the other hand, the second plunger 22 is urged upward as viewed in the figure, by the spring 24 such that it is moved away from the diaphragm 29, and hence urges the valve element 16 toward its fully open position via the shaft 17. Therefore, even when the rotational shaft of the variable displacement compressor is being driven for rotation by the engine in the above state, the variable displacement compressor is operated with the minimum displacement.

Now, when the maximum control current is supplied to the coil 30 of the solenoid, as in the case of the automotive air conditioner having been started, the first plunger 26 has been pressed downward as viewed in the figure by the high suction pressure Ps to be brought into abutment with the core 27, so that even if the first plunger 26 is attracted by the core 27, it remains in the same position. Therefore, in this case, the first plunger 26 and the core 27 behave as if they were a fixed core, so that the first plunger 26 attracts the second plunger 22 via the diaphragm 29 against the urging force of the spring 24. The second plunger 22 is attracted to be brought into contact with the diaphragm 29, whereby the second plunger 22 is moved downward as viewed in the figure. This allows the spring 18 to push the valve element 16 downward, thereby causing the valve element 16 to be seated on the valve seat 15, to fully close the valve section. This blocks off the passage extending from the discharge chamber to the crankcase, so that the variable displacement compressor is promptly shifted into the operation with the maximum capacity.

When the variable displacement compressor continues to operate with the maximum capacity to make the suction pressure Ps from the suction chamber low enough, the diaphragm 29 senses the suction pressure Ps and attempts to move upward as viewed in the figure. At this time, if the control current supplied to the coil 30 of the solenoid is decreased according to the set temperature of the air conditioner, the second plunger 22 and the first plunger 26 in the attracted state move in unison upward as viewed in the figure to respective positions where the suction pressure Ps, the loads of the springs 18, 24, and 28, and the attractive force of the coil 30 are balanced. This causes the valve element 16 to be pushed upward by the second plunger 22 to move away from the valve seat 15, thereby being set to a predetermined valve lift. Therefore, refrigerant at the discharge pressure Pd is introduced into the crankcase at a flow rate controlled to a value dependent on the valve lift, whereby the variable displacement compressor is shifted to an operation with the displacement corresponding to the control current.

When the control current supplied to the coil 30 of the solenoid is constant, the diaphragm 29 senses the suction pressure Ps as an absolute pressure to thereby control the valve lift of the valve section. For example, when the refrigeration load increases to make the suction pressure Ps high, the diaphragm 29 is displaced downward as viewed in the figure, so that the valve element 16 is also moved downward to decrease the valve lift of the valve section, causing the variable displacement compressor to operate in a direction of increasing the displacement. On the other hand, when the refrigeration load decreases to make the suction pressure Ps low, the diaphragm 29 is displaced upward as viewed in the figure to increase the valve lift of the valve section, causing the variable displacement compressor to operate in a direction of decreasing the displacement. Thus, the control valve controls the displacement of the variable displacement compressor such that the suction pressure Ps becomes equal to a value set by the solenoid.

Figure 4:
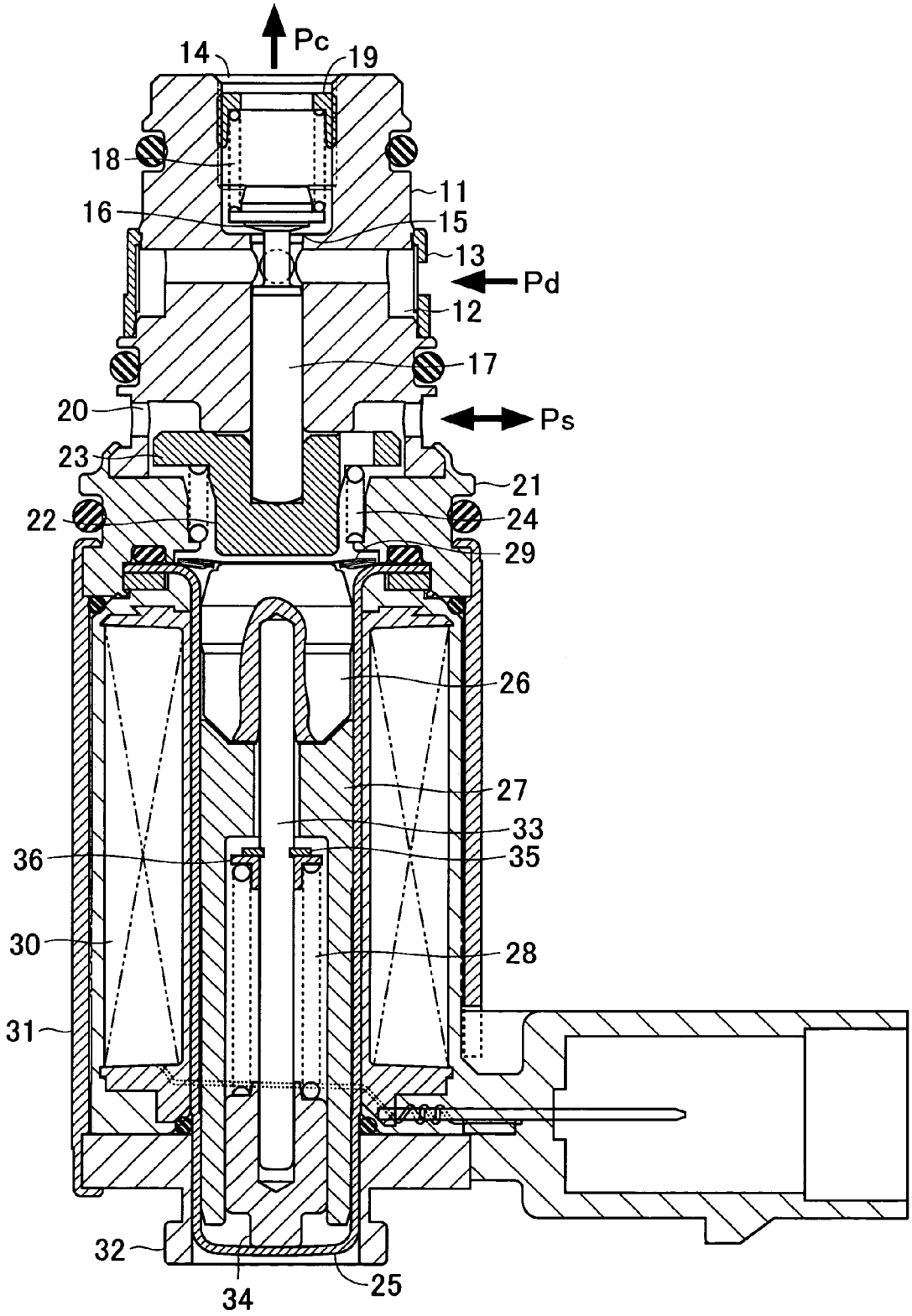
FIG. 4 is a central longitudinal cross-sectional view of the arrangement of a control valve for a variable displacement compressor, according to a second embodiment of the present invention.
Figure 5:
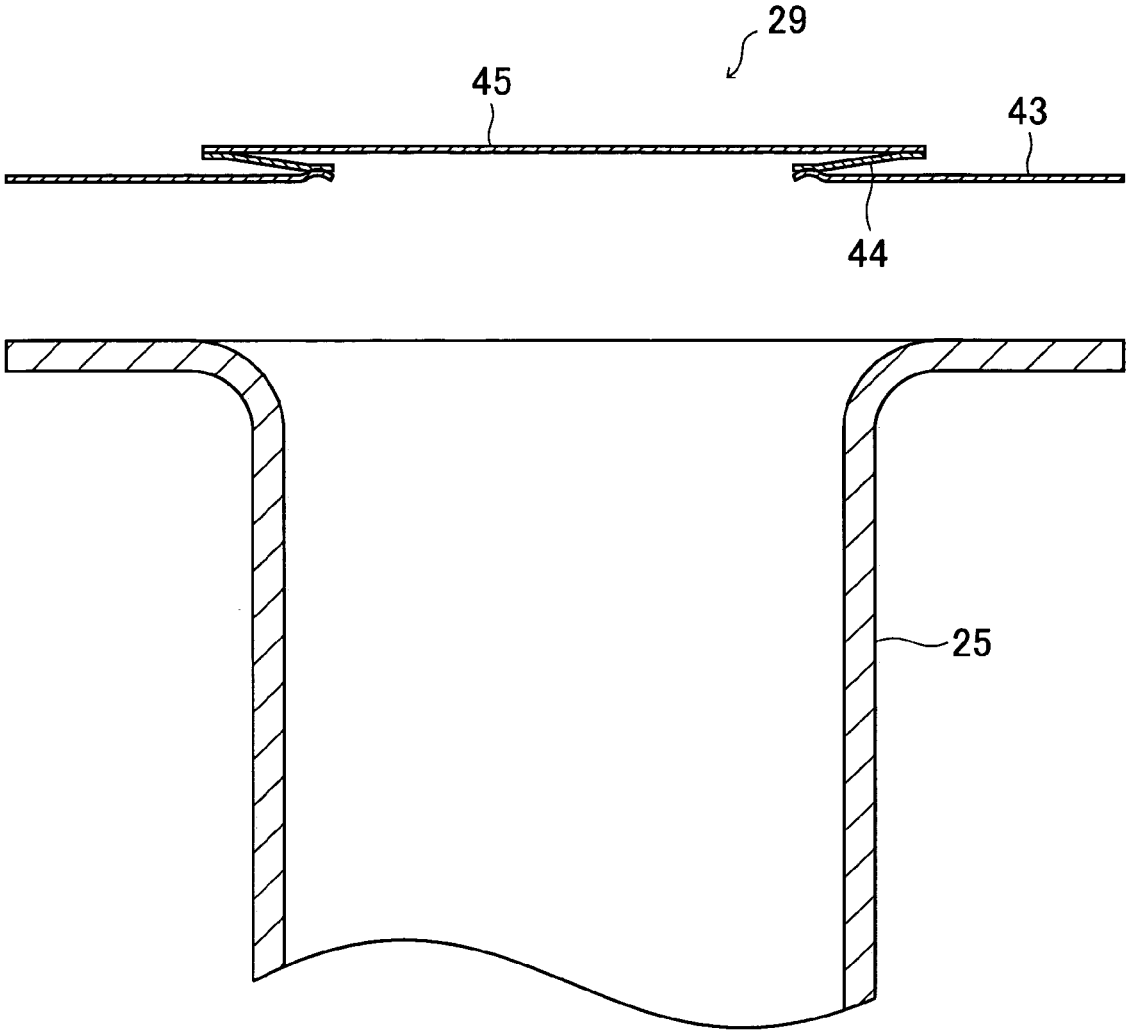
FIG. 5 is an enlarged exploded cross-sectional view showing a diaphragm and a bottomed sleeve.

FIG. 4 is a central longitudinal cross-sectional view of the arrangement of a control valve for a variable displacement compressor, according to a second embodiment of the present invention. FIG. 5 is an enlarged exploded cross-sectional view showing a diaphragm and a bottomed sleeve. It should be noted that component elements in FIG. 4 identical or similar in function to those in FIG. 1 are designated by identical reference numerals, and detailed description thereof is omitted.

The control valve for a variable displacement compressor of the second embodiment is distinguished from the control valve for a variable displacement compressor of the first embodiment in that the shape of the diaphragm 29 is modified. As shown in detail in FIG. 5, the present diaphragm 29 comprises three component parts. First, a base part 43 having a largest diameter has a central portion thereof formed with a hole, and is welded to the flange portion of the bottomed sleeve 25. An intermediate connecting part 44 in the form of a funnel is disposed on the base part 43, and a disk 45 is disposed on the intermediate connecting part 44 in a manner covering the upper opening of the same. The base part 43, the intermediate connecting part 44, and the disk 45 are formed e.g. of a stainless steel material. The base part 43 and the intermediate connecting part 44 have inner peripheral portions thereof welded to each other along the entire perimeters thereof e.g. by forming a protuberance along the inner peripheral edge of the base part 43 and projection-welding the inner peripheral portions of the two, and the intermediate connecting part 44 and the disk 45 have outer peripheral portions thereof welded to each other along the entire perimeters thereof e.g. by laser-welding. The diaphragm 29 is thus formed.

This diaphragm 29 can have a larger stroke in the direction of displacement than that of the control valve of the first embodiment in which the pressure-sensing section is formed by a single thin metal plate, and hence the control range of the valve section can be expanded.

Figure 6:
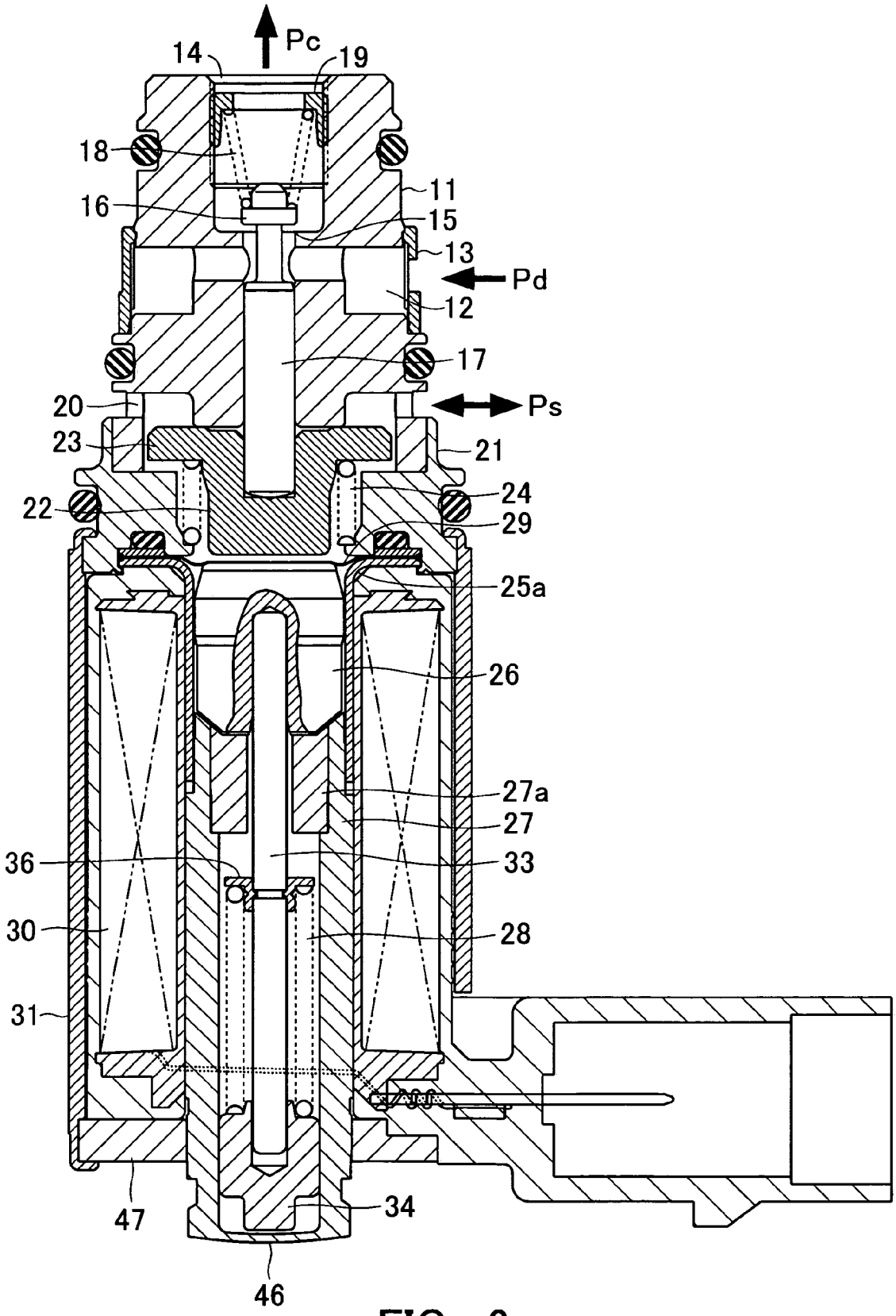
FIG. 6 is a central longitudinal cross-sectional view showing the arrangement of a control valve for a variable displacement compressor, according to a third embodiment of the present invention.
Figure 7:
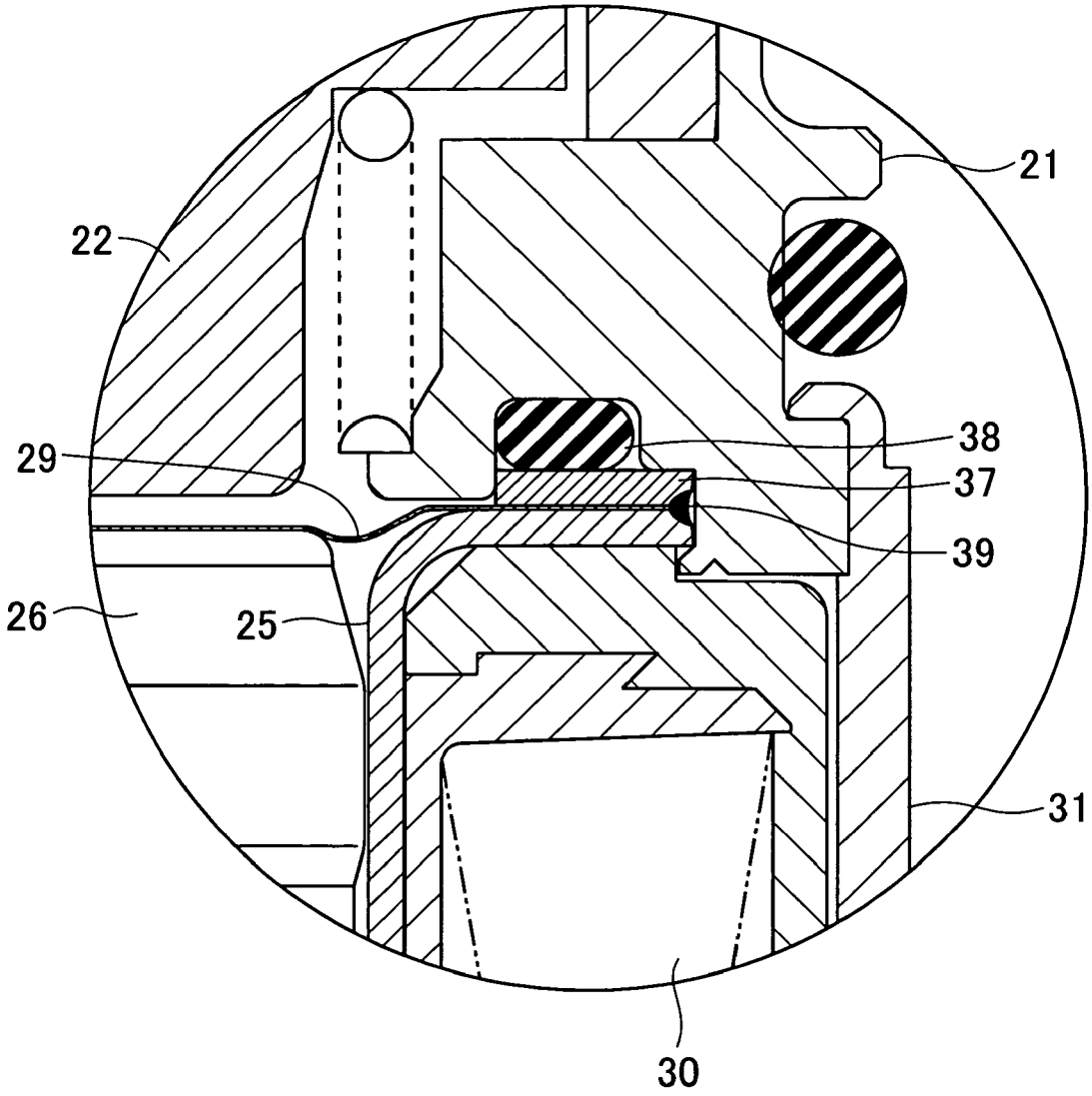
FIG. 7 is an enlarged fragmentary cross-sectional view showing a welded portion of a diaphragm.

FIG. 6 is a central longitudinal cross-sectional view of the arrangement of a control valve for a variable displacement compressor, according to a third embodiment of the present invention. FIG. 7 is an enlarged exploded cross-sectional view showing a welded portion of the diaphragm. It should be noted that component elements in FIG. 6 and FIG. 7 identical or similar in function to those in FIG. 1 and FIG. 2 are designated by identical reference numerals, and detailed description thereof is omitted.

The control valve for a variable displacement compressor of the third embodiment is distinguished from the control valve for a variable displacement compressor of the first and second embodiments in that the vacuum container is formed by a sleeve 25*a* and the cores 27 and 27*a* of the solenoid.

The sleeve 25*a* has an opening at the lower end thereof gastightly joined to the core 27 by brazing. The core 27 is integrally formed with a bottom 46 which is deformed by an external force to change the axial position of the bearing 34 to thereby adjust the load of the spring 28. The bottom 46 forms a closing portion that closes an internal space containing the shaft 33, the spring 28, and the bearing 34. Further, fitted into an open end of the core 27 which opens wide for having the shaft 33, the spring 28, and the bearing 34 inserted into the internal space is a hollow cylindrical core 27*a* formed with a through hole for passing the shaft 33 therethrough, whereby the area opposed to the first plunger 26 is increased.

The case 31 of the control valve for the variable displacement compressor has an annular plate 47 made of a magnetic material, fitted in a lower end thereof, and in the center of the annular plate 47, the core 27 is disposed in a manner extending therethrough. According to this arrangement, the plate 47 constitutes a yoke together with the case 31 and the core 27, for forming a magnetic circuit. With this arrangement, compared with the control valve for a variable displacement compressor according to the first and second embodiments, the magnetic circuit between the case 31 and the core 27 is made continuous by the plate 47, so that there is no magnetic gap produced by the interposition of the bottomed sleeve 25, which makes it possible to improve the attracting force characteristic of the solenoid.

Further, the sleeve 25*a* brazed to the core 27 is sealed by welding the diaphragm 29 to a flange portion formed at the open end of the sleeve 25*a*. For example, as shown in detail in FIG. 7, a gastight assembly having the inside thereof kept in a vacuum state is formed by placing the diaphragm 29 on the flange portion of the sleeve 25*a*, placing the annular patch 37 on the diaphragm 29, and circumferentially welding the outer peripheries of these members under vacuum atmosphere e.g. by laser welding along the entire perimeters thereof to form a weld line 39. The assembly thus constructed is fixed to the lower end of the body 21 by caulking via an O ring 38 sealing between the chamber into which suction pressure Ps is introduced and the atmosphere. Then, a one-piece member formed by a connector and the coil 30 is mounted to the body 21 from below as viewed in FIG. 6 in a manner such that the assembly of the vacuum container is fitted therein, and fixed thereto by caulking the upper end 41 of the case 31.

Figure 8:
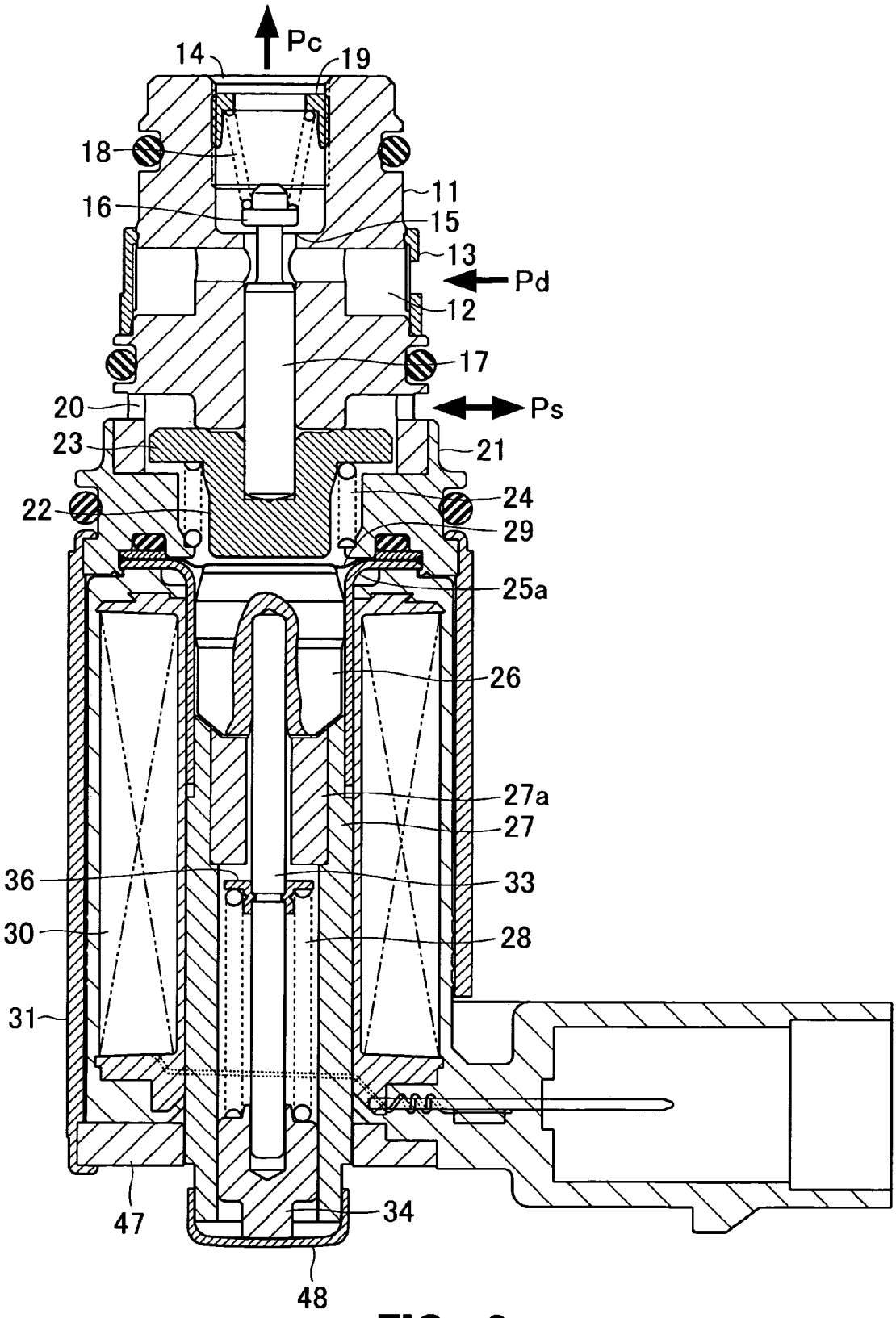
FIG. 8 is a central longitudinal cross-sectional view showing the arrangement of a control valve for a variable displacement compressor, according to a fourth embodiment of the present invention.

FIG. 8 is a central longitudinal cross-sectional view of the arrangement of a control valve for a variable displacement compressor, according to a fourth embodiment of the present invention. It should be noted that component elements in FIG. 8 identical or similar in function to those in FIG. 6 are designated by identical reference numerals, and detailed description thereof is omitted.

The control valve for a variable displacement compressor of the fourth embodiment is distinguished from the control valve for a variable displacement compressor of the third embodiment in that the core 27 has an opening in a lower end thereof, and the opening is closed with a cap 48.

The core 27 is in the form of a hollow cylinder having an opening in a lower end thereof, as viewed in FIG. 8, and the cap 48 is gastightly joined to the lower end of the core 27 by brazing. The cap 48 forms a closing portion that closes the space accommodating the shaft 33, the spring 28, and the bearing 34, and also forms a member which can externally adjust the load of the spring 28 by being deformed by an external force in a manner dented inward to change the axial position of the bearing 34 which is in abutment with the cap 48.

Figure 9:
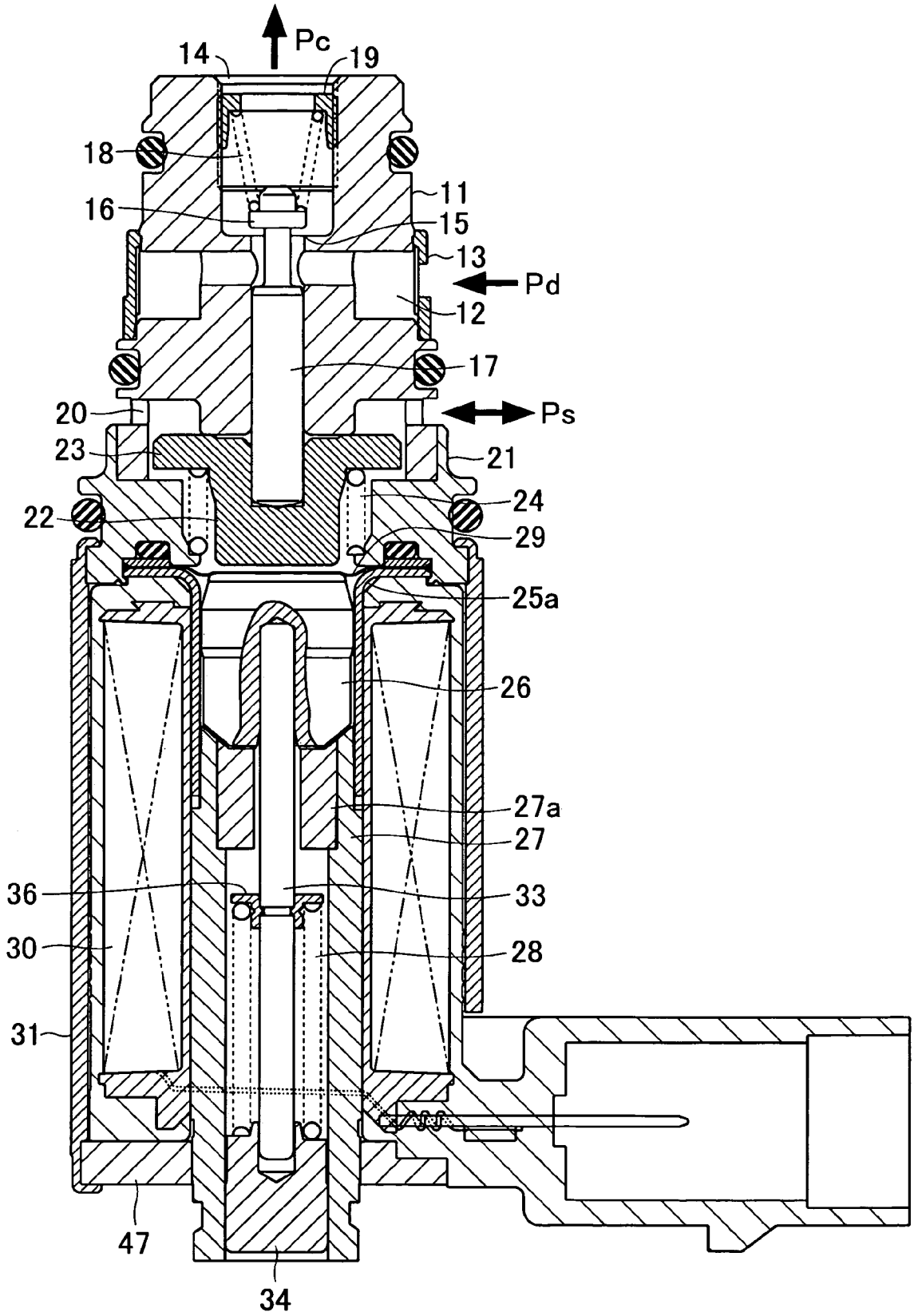
FIG. 9 is a central longitudinal cross-sectional view showing the arrangement of a control valve for a variable displacement compressor, according to a fifth embodiment of the present invention.

FIG. 9 is a central longitudinal cross-sectional view of the arrangement of a control valve for a variable displacement compressor, according to a fifth embodiment of the present invention. It should be noted that component elements in FIG. 9 identical or similar in function to those in FIG. 7 are designated by identical reference numerals, and detailed description thereof is omitted.

The control valve for a variable displacement compressor of the fifth embodiment is distinguished from the control valve for a variable displacement compressor of the fourth embodiment in that the closing portion that closes the space accommodating the shaft 33, the spring 28, and the bearing 34 is formed by the bearing 34 itself.

The core 27 is in the form of a hollow cylinder having an opening in a lower end thereof, as viewed in FIG. 9, and the bearing 34 is press-fitted into the core 27 from the opening of the lower end thereof. The bearing 34 forms a member which can externally adjust the load of the spring 28 by changing the amount of press-fitting thereof into the internal space of the core 27 by an external force.

The control valve for a variable displacement compressor, according to the present invention, is configured such that the vacuum container is formed by sealing the bottomed sleeve with the diaphragm, and the vacuum container is fixed to the body of the valve section. Further, the vacuum container is fixed to the body of the valve section with the solenoid coil arranged therearound. Therefore, the control valve is advantageous in its ease of construction.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A control valve for a variable displacement compressor, which is mounted on the variable displacement compressor for control of pressure in a gastightly-formed crankcase by sensing suction pressure, comprising:

a vacuum container that contains a first plunger in a state urged in a direction away from a core of a solenoid;

a diaphragm for sensing the suction pressure, the diaphragm sealing an open end of the vacuum container such that an inside of the vacuum container is kept gastight and having an inner surface with which the first plunger is in abutment in an urged state; and a second plunger that is disposed between the diaphragm and a valve section for controlling pressure in the crankcase, and urged in a direction away from the diaphragm such that the second plunger opens the valve section when the solenoid is not energized, wherein the first plunger and the second plunger are magnetically coupled via the diaphragm when the solenoid is energized.

2. The control valve according to claim 1, wherein the vacuum container is a bottomed sleeve that accommodates the core of the solenoid and the first plunger.

3. The control valve according to claim 2, wherein the core is press-fitted in the bottomed sleeve, and a magnetic gap between the core and the first plunger is adjusted by an amount of press-fitting of the core into the bottomed sleeve.

4. The control valve according to claim 3, wherein the bottomed sleeve has a bottom-side portion thereof formed as a part for press-fitting of the core by reducing a diameter of the bottom-side portion.

5. The control valve according to claim 2, comprising a shaft axially extending through the core and having one end thereof fixed to the first plunger, a bearing disposed in contact with a bottom of the bottomed sleeve and supporting the other end of the shaft, and a spring having one end thereof engaged with the shaft and the other end thereof held in abutment with the bearing and urging the first plunger in the direction away from the core, and wherein a position of the bearing receiving the spring is changed by deforming the bottom of the bottomed sleeve from outside such that the bottom is dented, to thereby adjust load of the spring.

6. The control valve according to claim 2, wherein the bottomed sleeve has a magnetic circuit portion thereof having a yoke disposed therearound, the magnetic circuit portion being caused to acquire magnetism such that the magnetic circuit portion forms a magnetic circuit together with the core disposed within the bottomed sleeve.

7. The control valve according to claim 6, wherein the magnetic circuit portion is caused to acquire magnetism by performing cold working thereon such that the bottomed sleeve formed straight is reduced in diameter.

8. The control valve according to claim 7, wherein the magnetic circuit portion is press-fitting portion wherein the core is fixed in the bottomed sleeve.

9. The control valve according to claim 1, wherein the vacuum container has a flange portion formed on an open end thereof, the diaphragm being circumferentially welded to the flange portion along an entire perimeter thereof to seal the vacuum container, and a sealing member for sealing between a space from which the diaphragm receives the suction pressure and the atmosphere is disposed radially inward of a position where the diaphragm is welded.

10. The control valve according to claim 1, wherein the diaphragm comprises a base part formed with a hole in a central portion thereof and welded to a flange portion formed on the open end of the vacuum container, a funnel-shaped intermediate connecting part having an inner periphery welded to an inner periphery of the base part, and a disk having an outer periphery welded to an outer periphery of the intermediate connecting part.

11. The control valve according to claim 1, wherein the vacuum container comprises a sleeve having one open end thereof sealed with the diaphragm and containing the first plunger, and the core disposed such that the core seals the other open end of the sleeve.

12. The control valve according to claim 11, wherein the core has a through hole through which axially extends a shaft in a manner extending through an end face of the core opposed to the first plunger, the shaft having one end thereof fixed to the first plunger, a space in which are arranged a bearing supporting the other end of the shaft, and a spring having one end thereof engaged with the shaft and the other end thereof in contact with the bearing, for urging the first plunger in a direction away from the core, via the shaft, the space being gastightly closed by a closing portion that can adjust load of the spring by receiving an external force from outside to thereby change an axial position of the bearing.

13. The control valve according to claim 12, wherein the closing portion is formed integrally with the core.

14. The control valve according to claim 12, wherein the closing portion is formed by the bearing press-fitted into the space.

* * * * *